US007671825B2

(12) United States Patent
Uchiyama et al.

(10) Patent No.: US 7,671,825 B2
(45) Date of Patent: Mar. 2, 2010

(54) METHOD OF DRIVING ORGANIC EL DEVICE AND DISPLAY DEVICE

(75) Inventors: Norikazu Uchiyama, Chikura (JP); Masaaki Okunaka, Fujisawa (JP); Masahiro Nishizawa, Mobara (JP); Hidetsugu Matsukiyo, Chiba (JP); Yuko Matsumoto, Onjuku (JP)

(73) Assignee: Hitachi Displays, Ltd., Chiba (JP)

( * ) Notice: Subject to any disclaimer, the term of this patent is extended or adjusted under 35 U.S.C. 154(b) by 980 days.

(21) Appl. No.: 11/361,364

(22) Filed: Feb. 24, 2006

(65) Prior Publication Data

US 2006/0197462 A1 Sep. 7, 2006

(30) Foreign Application Priority Data

Mar. 3, 2005 (JP) ..... 2005-058442

(51) Int. Cl.
*G09G 3/30* (2006.01)

(52) U.S. Cl. ..... 345/76; 345/77; 345/78; 345/79; 345/82; 345/84

(58) Field of Classification Search ..... 345/76–79, 345/82, 84
See application file for complete search history.

(56) References Cited

FOREIGN PATENT DOCUMENTS

JP 2000-030862 7/1998
JP 2000-036383 7/1998
JP 2000-036383 * 2/2000

* cited by examiner

*Primary Examiner*—Richard Hjerpe
*Assistant Examiner*—Leonid Shapiro
(74) *Attorney, Agent, or Firm*—Stites & Harbison PLLC; Juan Carlos A. Marquez, Esq.

(57) ABSTRACT

According to one aspect of the present invention, it is possible to sufficiently perform the discharging of charge without lowering the light emitting efficiency of an organic EL device and hence, the device can exhibit the light emitting efficiency higher than a conventional organic EL device and, at the same time, can prevent the degradation of the device. As an organic EL device to which the present invention is applied, on a glass transparent substrate, a transparent electrode, a hole injection layer and a hole transport layer which function as a hole transport function layer, a light emitting layer, an electron transport function layer, and a metal electrode are formed sequentially, and a drive power sources are connected to the transparent electrode and the metal electrode. Further, from the drive power source, as an applying voltage, a voltage which is obtained by overlapping any one of a sine wave, a pulse wave, a triangle wave and a sawtooth wave having two cycles or more to a drive signal or a voltage which is obtained by overlapping a sine wave having two cycles or more to the drive signal is supplied.

18 Claims, 7 Drawing Sheets

Sine Wave 1

Pulse Wave

Sine Wave 2
(Limited Peak Voltage)

Triangle Wave

FIG. 11

| | Thickness (*1) | Overlapped Wave Form | AC Frequency (Hz) | Peak Current Density ($mA/cm^2$) | Half Luminance Lifetime (hour) |
|---|---|---|---|---|---|
| ex.1 | 40/40/40/40 | Sine Wave | 1000 | 17 | 3600 |
| ex.2 | 40/40/40/40 | Triangle Wave | 1000 | 15 | 3700 |
| ex.3 | 40/40/40/40 | Pulse Wave | 1000 | 16 | 3500 |
| ex.4 | 40/40/40/40 | Sawtooth Wave | 1000 | 14 | 3400 |
| ex.5 | 40/40/40/40 | Sine Wave (Overlapped to Direct Current) | 1000 | 24 | 3300 |
| ex.6 | 40/40/80/40 | Sine Wave | 1000 | 21 | 3100 |
| ex.7 | 40/40/40/40 | — | — | 15 | 2100 |
| ex.8 | 40/40/80/40 | — | — | 22 | 1700 |

*1 : CuPc/ α-NPD/Alq3+TPB/Alq3

METHOD OF DRIVING ORGANIC EL DEVICE AND DISPLAY DEVICE

CROSS-REFERENCE TO RELATED APPLICATIONS

The disclosure of Japanese Patent Application No. P2005-058442 filed on 2005/03/03 (yyyy/mm/dd) including the claims, the specification, the drawings and the abstract is incorporated herein by reference in its entirety.

BACKGROUND

1. Field of the Invention

The present invention relates to a method of driving an organic EL device and a display device which can prolong a lifetime of luminance, can prevent the elevation of a drive voltage or the increase of a drive current at the time of driving of the organic EL device with a fixed current.

2. Description of Related Art

An organic EL device, in general, has the structure in which an organic thin film containing a light emitting layer is sandwiched by an anode and a cathode, and by applying a DC voltage to the organic EL film, holes are injected from the anode and electrons are injected from the cathode thus emitting light. When the balance of electrons and holes is collapsed due to the influence of the charge transfer and the energy barrier of the materials which constitute these layers, the charge stored stage continues. Due to a portion of the charge stored in the organic thin film, the organic material is degenerated or the structure of the organic layer is changed. Such degeneration of the organic material and change of the structure of the organic layer has been one of causes of the deterioration of the organic EL device.

In Japanese Laid-open publication 2000-30862 (patent document 1), there exists a description that by driving a single-layered or stacked-layered organic EL device by applying a sinusoidal AC voltage between an anode and a cathode and by periodically changing the voltage applied to the device so as to periodically repeating an ON state (emission of light) and an OFF state (non-emission of light) of the device, the deterioration is recovered at the OFF state thus prolonging a driving lifetime.

In Japanese Laid-open publication 2000-36383 (patent document 2), there exists a description that by driving a single-layered or stacked-layered organic EL device by applying a pulse voltage of frequency of 5 kHz or more between an anode and a cathode and by setting the frequency at the time of performing this pulse driving to 5 kHz or more, a recovery effect of the deterioration at the time of OFF state is increased and hence, the deterioration of the device is suppressed.

SUMMARY

In the above-mentioned patent document 1, to obtain the same luminance also with respect to the DC voltage driving, it is necessary to increase the applied voltage thus lowering the efficiency of emission of light. Further, a large amount of current flows momentarily and a larger quantity of charge is stored and hence, a deterioration prevention effect is low.

In the above-mentioned patent document 2, the deterioration prevention effect is increased by the number of times that the voltage of pulse wave is off. That is, the patent document 2 does not refer to the inverse bias voltage or the like when the light emitting signal is off and hence, there may be a case that the discharging of the stored charge is not sufficient.

Accordingly, the present invention focuses on a method of applying an AC voltage as a means to apply the inverse bias to the organic EL device for discharging the stored charge.

That is, as the main reason of the deterioration of the organic EL device, when the organic EL device is driven with the voltage in the forward direction, there exist drawbacks that a driving force is increased due to the storing of charge in a short period and the degradation and the deterioration of the organic material which forms the device are generated due to the stored charge in a long period thus lowering the luminance.

Accordingly, as means to prevent such drawbacks, to discharge the stored charge, a positive and negative voltage in turn which is smaller than an absolute value of a light emitting start voltage (hereinafter referred to as "built-in-voltage") of the organic EL device may be applied or overlapped to the drive signal during a period in which the drive signal is off. Here, the drive signal is a voltage which is applied between the anode and the cathode and drives the organic EL element.

Further, with respect to the applied or overlapped voltage, after examining the voltage dependency of the organic EL device on the electrostatic capacitance, by applying the voltage (which is smaller than built-in-voltage) which generates a peak electrostatic capacitance, it is possible to perform the efficient discharging of the stored charge. Here, the applied or overlapped voltage is a voltage which is smaller than the built-in-voltage and hence, light is not emitted.

By setting the frequency of the applied voltage smaller than the frequency which corresponds to a response speed of the device and by setting the frequency to a frequency which assumes two cycles or more during time in which the drive signal is off, it is possible to perform the efficient discharge of a carrier.

These operations are performed irrespective of the structure and the material of the device.

In this manner, according to the present invention, in addition to the drive signal, by applying the voltage which is smaller than the absolute value of the built-in-voltage between devices, by applying the positive and negative signal in turn which is equal to the absolute value of the voltage at which the device assumes the maximum electrostatic capacitance, by applying the frequency which is smaller than the frequency corresponding to the response speed of the device and takes two cycles or more during the time that the drive signal is off or by applying a voltage waveform which is obtained by a plurality of these application modes, it is possible to sufficiently discharge the charge without lowering the light emitting efficiency of the organic EL device thus providing the organic EL device which can prevent the deterioration thereof while exhibiting the high light emitting efficiency.

That is, by applying the voltages of positive and negative signals when the emission of light (drive signal) of the organic EL device is off, the reverse potential is generated and hence, the stored charge can be discharged whereby the deterioration of the organic layer can be suppressed.

That is, as a cause of the deterioration of the organic layer, in an experiment which injects only the electrons and the holes, when the balance between the electron and the hole in the organic layer collapses, the increase of the resistance value or the lowering of the luminance is observed. Accordingly, it is considered that the cause of the deterioration of the organic layer attributes to the presence of the extra charge (stored charge) in the organic layer.

It is considered that the storage of charges is generated on an interface due to the energy barrier between the organic layers and hence, when the storage of the charge is generated on all respective interfaces, the storage quantity of the charge becomes largest.

Further, the electrostatic capacitance of the device is inversely proportional to the film thickness and when the electrostatic capacitance of the device is measured while gradually increasing the voltage, the charge is gradually injected by getting over the energy barrier and hence, an effective film thickness is decreased whereby the electrostatic capacitance of the device is increased.

Since the storage of the charge becomes largest at the voltage whose electrostatic capacitance is maximum, by applying the same voltage in the reverse direction, the stored charge can be discharged.

Here, when the voltage having the electrostatic capacitance which exceeds the maximum value is applied, the storage of undesired charge and the undesired emission of light are generated, while when the voltage having the electrostatic capacitance which is below the maximum value is applied, the discharging of the stored charge becomes insufficient. Accordingly, due to the application of the voltage of the maximum electrostatic capacitance, it is possible to prevent the discharging of the stored charge.

Further, since the stored charge is discharged during the time that the emission of light (drive signal) is off, it is necessary to turn the applied voltage into the inverse bias, and the larger the number of turning the applied voltage into the inverse bias, the charge can be discharged effectively and hence, it is desirable to adopt the frequency which sets the number of the inverse bias at least two cycles or more during the time that the emission of light (drive signal) is off.

Here, when the cycle of the applied AC voltage is shorter (the frequency of the applied voltage is larger) than the response time of the organic EL device, the movement of the charge cannot follow the change of the applied voltage and hence, the discharging of the stored charge becomes insufficient. Accordingly, although the response time differs depending on the structure of the device, according to an experiment on the transitional responsiveness, the response time is approximately $10^{-8}$ to $10^{-7}$ seconds and hence, it is desirable to set the frequency of the applied AC voltage to 10 MHz or less.

As described above, when the organic EL device is driven, it is possible to suppress the deterioration of the organic layer, the elevation of voltage (the lowering of movement of the charge, the lowering of the charge injection efficiency due to the degeneration of the respective organic layer and the electrode interface).

In this manner, it is possible to suppress the deterioration of the organic layer attributed to the storage of the charge and hence, it is possible to suppress the lowering of the luminance of the organic EL device and the elevation of the drive voltage. Since the lowering of the luminance and the elevation of the voltage can be suppressed, it is possible to enhance the lifetime of the device.

BRIEF DESCRIPTION OF THE DRAWINGS

FIG. 11 is a table showing driving conditions of respective experiments and respective measuring effects.

DETAILED DESCRIPTION OF THE INVENTION

Hereinafter, embodiments of the present invention are explained in conjunction with drawings.

Embodiment 1

Hereinafter, an organic EL device according to the present invention can selectively use known materials and, at the same time, can properly adopt the known structure.

Here, first of all, experimental examples on the storage of charge, the electrostatic capacitance and the response speed of the organic EL device are explained.

Figure 5:
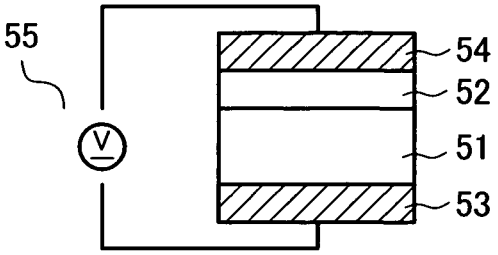
FIG. 5 is a view showing an experimental method of a charge balance.
Figure 6:
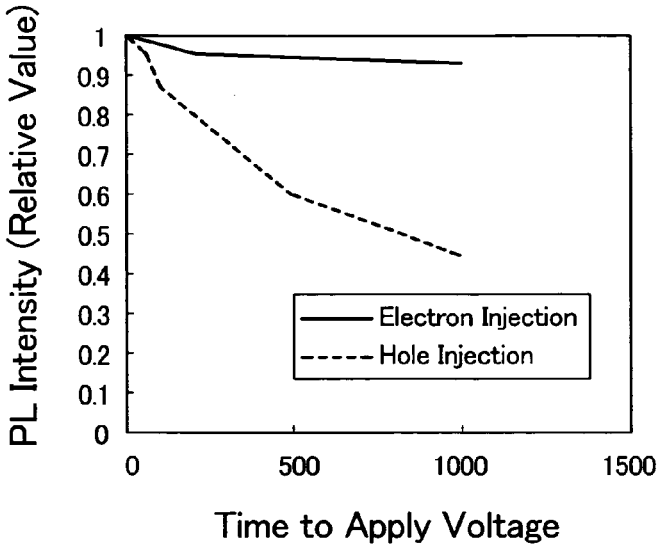
FIG. 6 is a PL intensity change diagram due to the injection of charge.
Figure 7A:
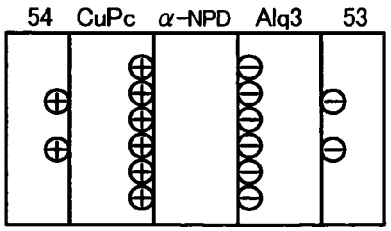
FIG. 7 is a view showing the storage of the charge due to the voltage.
Figure 7B:
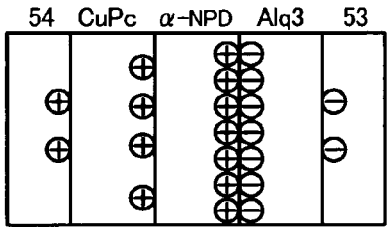

FIG. 5 is a view showing an experimental method of charge balancing and shows the cross-sectional structure of the device in which an organic layer is sandwiched between two electrodes and a state in which a voltage is applied to the electrodes using a drive power source. FIG. 6 shows a PL intensity change diagram due to the injection of electrons and holes, that is, the injection of the charge. FIG. 7A and FIG. 7B are views which schematically show the charge stored states for every magnitudes of applied voltage, wherein FIG. 7A schematically shows the charge stored state when a voltage which is sufficiently lower than a voltage with which the electrostatic capacitance becomes maximum is applied and FIG. 7B schematically shows the charge stored state when a voltage which is sufficiently lower than a voltage with which the electrostatic capacitance becomes maximum is applied.

As shown in FIG. 5, a device having the structure in which a dielectric layer 52 is formed on one surface of an organic layer 51 and the dielectric layer 52 is sandwiched by electrodes 53, 54 is prepared and an experiment which applies a DC voltage from a drive power source 55 is performed. Here, by changing the polarity of the applied voltage, it is possible to inject only electrons or holes to the inside of the organic layer 51 from the organic layer 51 side with which the electrode 53 is directly brought into contact. The reason that only the electrons and the holes can be injected is attributed to the presence of the dielectric layer 52 on one surface of the organic layer 51.

By performing a comparison of a phosphor intensity (PL intensity) before and after the above-mentioned injection of the charge, it is possible to confirm whether the change of the phosphor intensity attributed to the storage of charge is generated or not. When this experiment is performed using the device having the structure in which known CuPc (copper phthalocyanine), α-NPD (α-naphthyl phenyl diamine) and Alq3 (tris(8-quinolinol) aluminum are sequentially stored as an organic layer, as shown in FIG. 6, although the phosphor intensity is not changed substantially due to the injection of electrons, while the phosphor intensity is largely lowered due to the injection of holes. From this result, it is understood that, in this device structure, the phosphor intensity is degraded in the excessive hole state.

Next, as shown in FIG. 7A and FIG. 7B, when the applied voltage 54 is gradually increased, the charged stored state is changed from a state shown in FIG. 7A to a state shown in FIG. 7B and the electrons are injected by getting over an energy barrier between the respective layers. Here, a portion of the charge is stored in an interface. Then, a maximum amount of charge is stored immediately before the starting of the emission of light. Since an effective film thickness of the electrostatic capacitance becomes minimum, the electrostatic capacitance becomes maximum.

Figure 8:
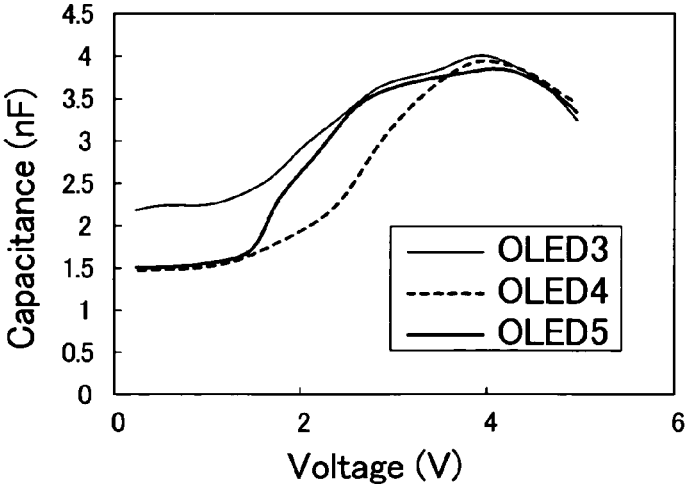
FIG. 8 is a view showing the relationship between the voltage and the electrostatic capacitance.

With respect to the device which is constituted by sequentially stacking CuPc, α-NPD and Alq3, a device 3 (OLED3) which is constituted of CuPc having a film thickness of 40 nm, α-NPD having a film thickness of 40 nm and Alq3 having a film thickness of 40 nm, a device 4 (OLED4) which is constituted of CuPc having a film thickness of 40 nm, α-NPD having a film thickness of 80 nm and Alq3 having a film thickness of 40 nm, and a device 5 (OLED5) which is constituted of CuPc having a film thickness of 40 nm, α-NPD having a film thickness of 80 nm and Alq3 having a film thickness of 80 nm are prepared, and the electrostatic capacitances of these devices are measured by changing the voltage. FIG. 8 shows a result of the measurement. As shown in FIG. 8, the change of the electrostatic capacitance differs depending on the film thickness of the constituting layers. However, the energy barriers of the respective layers are equal and hence, the voltages which generate the maximum electrostatic capacitance are substantially equal.

Figure 9:
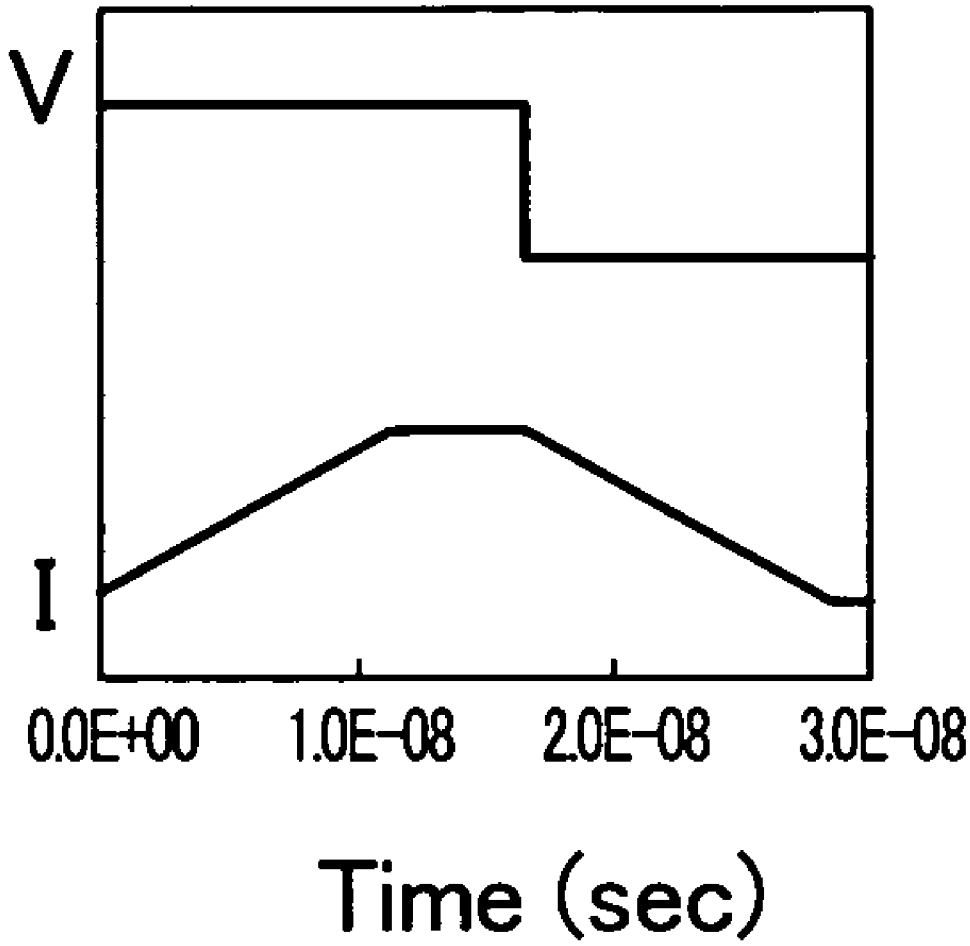
FIG. 9 is a view expressing a response speed of the organic EL device.

Next, although the response time differs due to the structure of the organic EL device, according to a result of an experiment on the transitional responsiveness, as shown in FIG. 9, the response time is approximately $10^{-8}$ to $10^{-7}$ seconds. Accordingly, it is preferable that the frequency of the applied voltage 54 at the AC current is 10 MHz or below.

In view of the above-mentioned experimental result, this embodiment is explained hereinafter.

Figure 1:
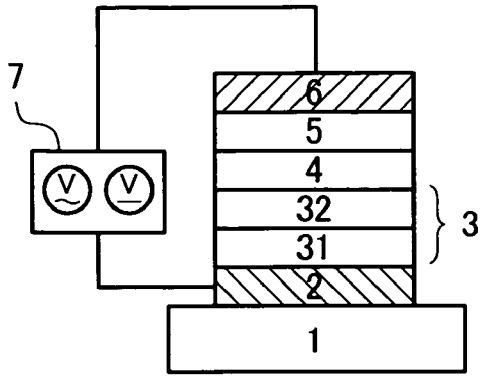
FIG. 1 is a schematic structural cross-sectional view of an organic EL device according to the present invention.

FIG. 1 is a view showing the structure of an organic EL device, wherein an ITO film is formed on a glass transparent substrate 1 by sputtering and, thereafter, the patterning for forming lines and electrodes is performed so as to form a transparent electrode 2 which constitutes an anode.

On this transparent electrode 2, CuPc which constitutes a hole injection layer 31 and α-NPD which constitutes a hole transport layer 32 are formed as first and second hole transport function layers 3.

Next, Alq3 which constitutes a host material of a light emitting layer 4, known TPB (tetra phenyl butadiene) which constitutes a dopant material of the light emitting layer 4, Alq3 which constitutes an electron transport function layer 5, and lithium fluoride or aluminum which constitutes a metal electrode 6 as a cathode are sequentially formed by a vapor deposition method in this order.

To drive the organic EL device formed in this manner, a drive power source 7 is connected to the transparent electrode 2 and the metal electrode 6, and a voltage supplied from the drive power source 7 is applied to the organic EL device.

Here, an organic EL device which respectively sets a film thicknesses of the hole injection layer (CuPc), the hole transport layer (α-NPD) and the light emitting layer (Alq3+TPB), and the electronic transport function layer (Alq3) in the organic layer to 40 nm, 40 nm, 40 nm, 40 nm is used as an "organic EL device 1" or an "organic electroluminescent device 1 (OLED1), and an organic EL device which respectively sets a film thicknesses of the hole injection layer (CuPc), the hole transport layer (α-NPD) and the light emitting layer (Alq3+TPB), and the electronic transport function layer (Alq3) in the organic layer to 40 nm, 40 nm, 80 nm, 40 nm is used as an "organic EL device 2" or an "organic electroluminescent device 2 (OLEDD2).

Figure 2:
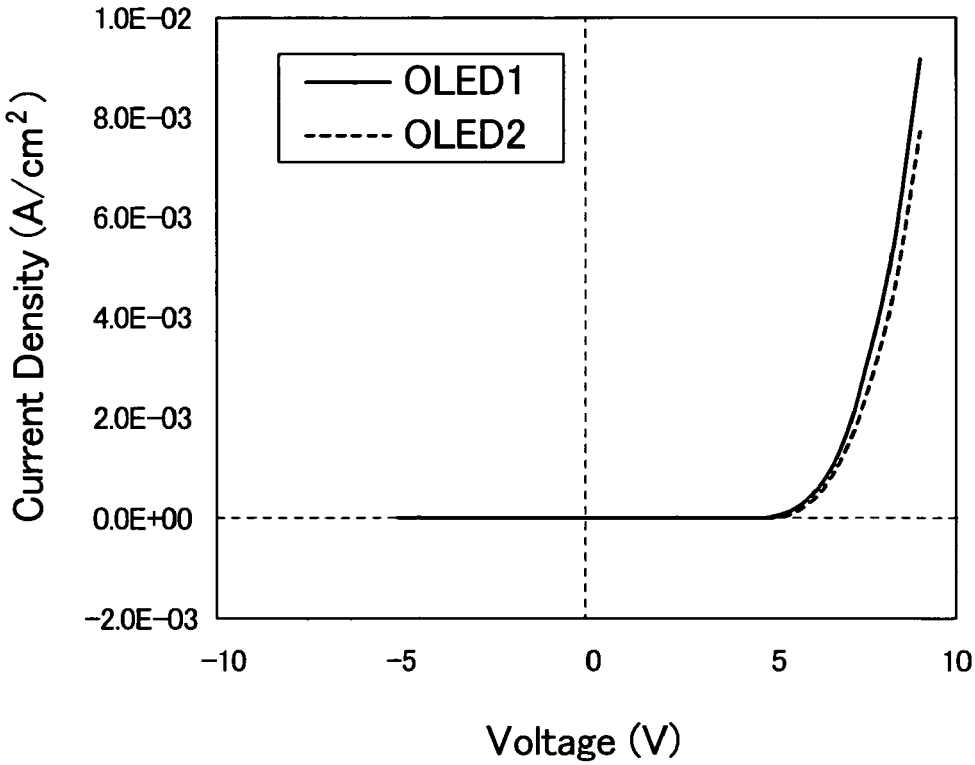
FIG. 2 is a voltage-current characteristic diagram of the organic EL device.
Figure 3A:
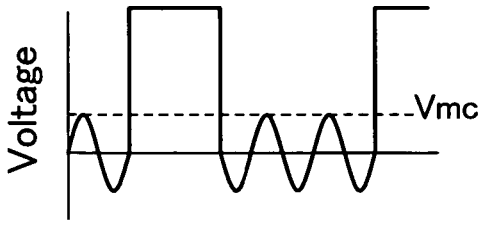
FIG. 3 is a waveform diagram of an applied voltage.
Figure 3B:
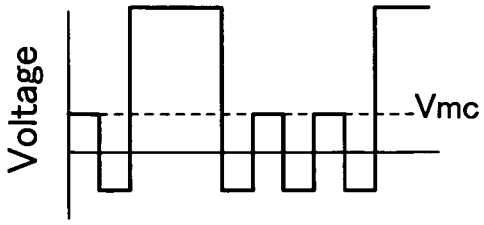
Figure 3C:
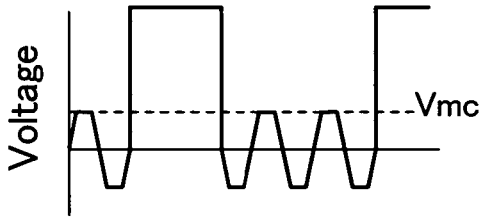
Figure 3D:
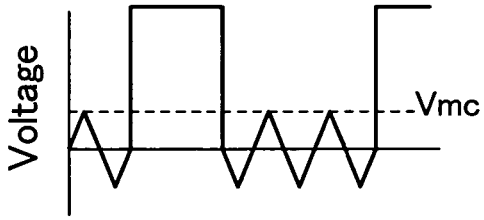
Figure 3E:
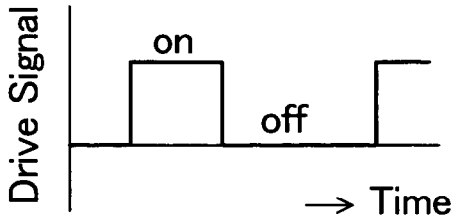

FIG. 2 is a voltage-current characteristic diagram of these organic EL devices. As shown in the drawing, with respect to both organic EL devices, an electric current does not flow in a range of the applied voltage from minus voltage to 4V and the electric current starts flowing at the voltage of 4V or more and the emission of light starts. That is, the built-in-voltage is 4V.

Here, the voltage (Vmc, see FIG. 3 and FIG. 4) which generates the maximum electrostatic capacitance of the organic material is 3.8V. Accordingly, the applied positive and negative voltages are set to ±3.8V.

Figure 4A:
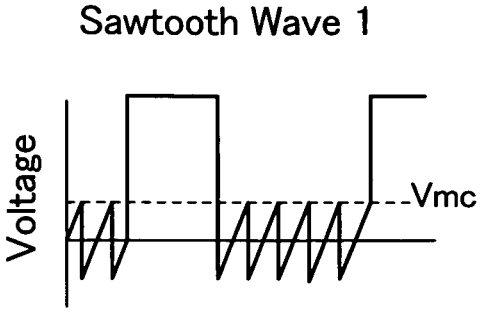
FIG. 4 is a waveform diagram of an applied voltage.
Figure 4B:
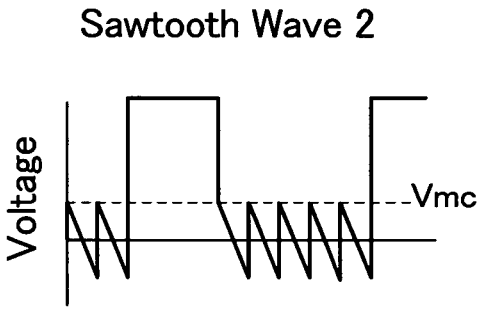
Figure 4C:
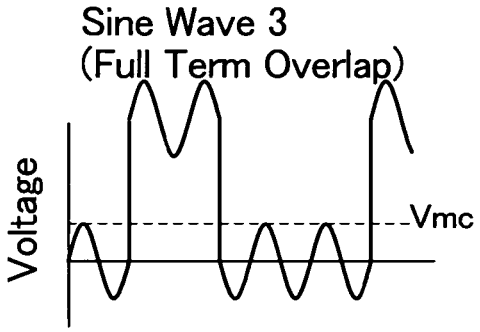

Waveforms of the applied voltage are shown in FIG. 3 and FIG. 4. Symbol 3E in FIG. 3 is a waveform referred to as a drive signal which is a voltage for controlling the turning ON and OFF of an organic EL element. In this embodiment, the waveform 3E is a square waveform.

Symbols 3A to 3D in FIG. 3 and symbols 4A to 4C in FIG. 4 are waveform charts in each of which a given waveform is overlapped to the drive signal only during an OFF state or the given waveform is overlapped to the drive signal in both of the ON period and the OFF period.

Symbol 3A in FIG. 3 is the waveform chart in which a sine wave 1 is overlapped to the drive signal during the OFF period.

Symbol 3B in FIG. 3 is the waveform chart in which a pulse wave is overlapped to the drive signal during the OFF period.

Symbol 3C in FIG. 3 is the waveform chart in which a sine wave 2 which is a limited peak voltage is overlapped to the drive signal during the OFF period.

Symbol 3D in FIG. 3 is the waveform chart in which a triangle wave is overlapped to the drive signal during the OFF period.

Symbol 4A in FIG. 4 is the waveform chart in which a sawtooth wave 1 is overlapped to the drive signal during the OFF period.

Symbol 4B in FIG. 4 is the waveform chart in which a sawtooth wave 2 which has a phase opposite to a phase of the sawtooth wave 1 is overlapped to the drive signal during the OFF period.

Symbol 4C in FIG. 4 is the waveform chart in which a sine wave 3 is overlapped to the drive signal not only during the OFF period but also during the ON period.

This embodiment can adopt any one of these waveforms.

In these waveforms, when the drive signal (a) is off, any one of the periodical sine wave, pulse wave, triangle wave and sawtooth wave is applied during two cycles or more.

In experimental examples described hereinafter, a DC voltage of the drive power source 7 is adjusted such that the luminance assumes 1000 cd/$m^2$ with respect to the above-mentioned organic EL device.

EXPERIMENTAL EXAMPLE 1

In the above-mentioned organic EL device 1, when the sine wave voltage is set to 3.8V and the frequency is set to 1000 HZ, the peak current is 17 mA/$Cm^2$. When the organic EL device 1 is driven by controlling the DC voltage such that the current value always assumes a fixed value, the luminance half-life time is 3600 h.

EXPERIMENTAL EXAMPLE 2

In the above-mentioned organic EL device 1, when the triangle wave voltage is set to ±3.8V and the frequency is set to 1000 Hz, the peak current is 15 mA/$cm^2$. When the organic EL device 1 is driven by controlling the DC voltage such that the current value always assumes a fixed value, the luminance half-life time is 3700 h.

EXPERIMENTAL EXAMPLE 3

In the above-mentioned organic EL device 1, when the pulse wave voltage is set to ±3.8V and the frequency is set to 1000 Hz, the peak current is 16 mA/cm$^2$. When the organic EL device 1 is driven by controlling the DC voltage such that the current value always assumes a fixed value, the luminance half-life time is 3500 h.

EXPERIMENTAL EXAMPLE 4

In the above-mentioned organic EL device 1, when the sawtooth wave voltage is set to ±3.8V and the frequency is set to 1000 Hz, the peak current is 14 mA/cm$^2$. When the organic EL device 1 is driven by controlling the DC voltage such that the current value always assumes a fixed value, the luminance half-life time is 3400 h.

EXPERIMENTAL EXAMPLE 5

In the above-mentioned organic EL device 1, when the organic EL device 1 is driven by overlapping the sine wave to the DC current corresponding to the light emitting signal, the sine wave voltage is set to ±3.8V and the frequency is set to 1000 Hz, the peak current is 24 mA/cm$^2$. When the organic EL device 1 is driven by controlling the DC voltage such that the current value always assumes a fixed value, the luminance half-life time is 3300 h.

EXPERIMENTAL EXAMPLE 6

In the above-mentioned organic EL device 2, when the sine wave voltage is set to 3.8V and the frequency is set to 1000 Hz, the peak current is 21 mA/cm$^2$. When the organic EL device 2 is driven by controlling the DC voltage such that the current value always assumes a fixed value, the luminance half-life time is 3100 h.

EXPERIMENTAL EXAMPLE 7

In the above-mentioned organic EL device 1, when only the DC voltage is applied to the organic EL device 1 and the DC voltage is adjusted to set the luminance to 1000 cd/m$^2$, the peak current is 15 mA/cm$^2$. When the organic EL device 1 is driven by controlling the DC voltage such that the current value always assumes a fixed value, the luminance half-life time is 2100 h.

EXPERIMENTAL EXAMPLE 8

In the above-mentioned organic EL device 2, when only the DC voltage is applied to the organic EL device 2 and the DC voltage is adjusted to set the luminance to 1000 cd/m$^2$, the peak current is 22 mA/cm$^2$. When the organic EL device 2 is driven by controlling the DC voltage such that the current value always assumes a fixed value, the luminance half-life time is 1700 h.

To sum up these relationships, it is possible to obtain a result shown in a table in FIG. 11.

In this manner, in the driving of the organic EL device, by applying the positive and negative signal in turn corresponding to the voltage which provides the maximum electrostatic capacitance value of the device in addition to the drive signal, the life time property of the organic EL device can be enhanced.

Embodiment 2

Figure 10A:
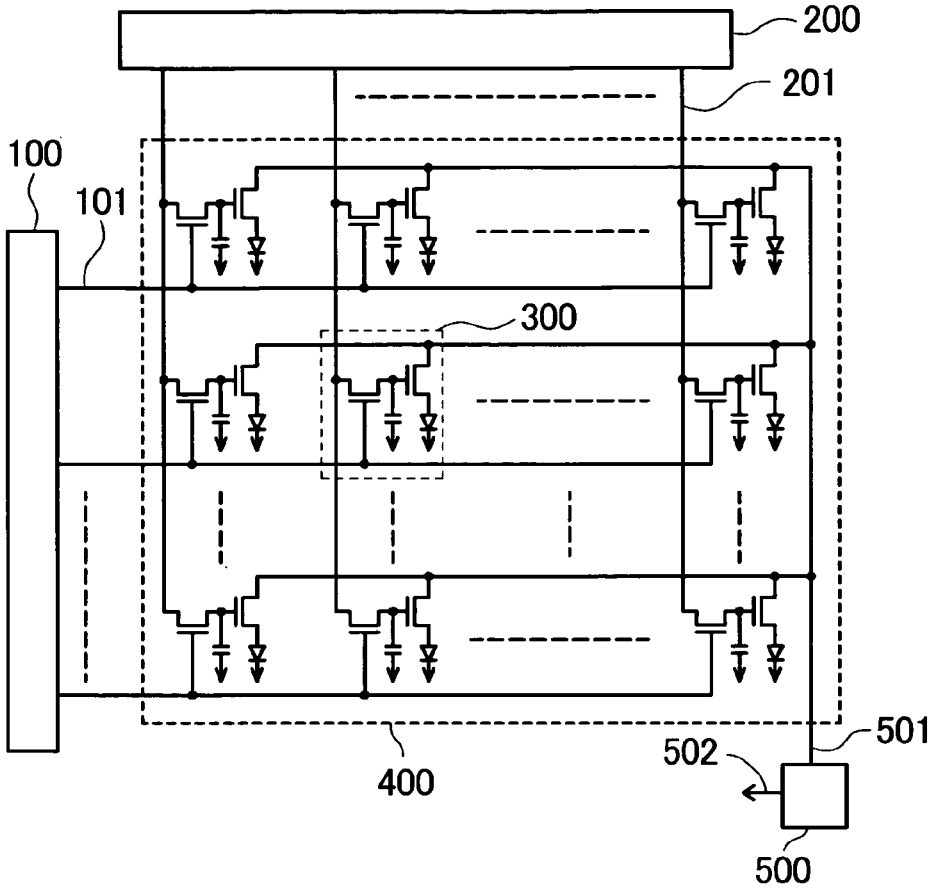
FIG. 10 is a schematic view of the display device using the organic EL device according to the present invention.
Figure 10B:
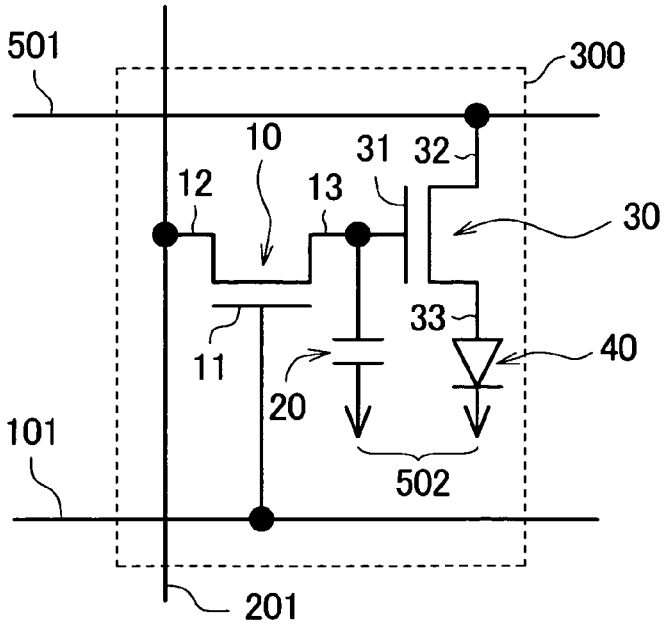

In FIG. 10A and FIG. 10B, FIG. 10A is a schematic view of an active matrix display device which uses the organic EL device according to the present invention, and FIG. 10B is an enlarged view of a pixel portion 300 shown in FIG. 10A.

In FIG. 10A, in response to a scanning line 101 which is selected by a scanning line driving circuit 100, a data signal is supplied to the pixel portion 300 of a display panel 400 from the data line driving circuit 200 by way of a data line 201. To the pixel portion 300, an applying voltage which is formed by adding the sine wave, the pulse wave, the triangle wave or the sawtooth wave to the drive signal is supplied from a drive power source 500 by way of a driving line 501. Here, a common electrode 502 of the drive power source 500 is connected to a common electrode of the display panel 400.

In FIG. 10B, a first thin film transistor 10 is provided to an intersection of the scanning line 101 and the data line 201, the scanning line 101 is connected to a gate electrode 11 of the first thin film transistor 10, and the data line 201 is connected to a source electrode (or a drain electrode) 12 of the first thin film transistor 10, and one electrode of a holding capacitance 20 which temporarily holds the data signal is connected to the drain electrode (or the source electrode) 13 of the first thin film transistor 10. Further, the drain electrode 13 of the first thin film transistor 10 is connected to the gate electrode 31 of the second thin film transistor 30.

To a source electrode (or a drain electrode) 32 of the second thin film transistor 30, a driving line 501 is connected, while to the drain electrode (or the source electrode) 33 of the second thin film transistor 30, one electrode of an organic EL device 40 is connected. Another electrode of the organic EL device 40 is connected to a common electrode 502 together with another electrode of the holding capacitance 20.

In the display device having such a constitution, due to the scanning line driving circuit 100 and the data line driving circuit 200, the data signal is temporarily held in the holding capacitance 20 in the selected pixel portion 300, the applying voltage from the drive power source 500 is supplied to the organic EL device 40 in response to the data signal held in the holding capacitance 20, and the organic EL device 40 emits light. Here, the organic EL device 40 in the non-selected pixel portion 300 emits light in response to the data signal held by the holding capacitance 20.

What is claimed is:

1. A display device which includes a drive power source for supplying a drive signal to organic EL devices which are arranged in a matrix array on respective intersecting portions of a plurality of scanning lines and a plurality of data lines, wherein the drive power source supplies a positive and negative voltage in turn which is smaller than an absolute value of a light emitting start voltage of the organic EL device during an off period of the organic EL device, wherein a number of pulses of the positive and negative voltage which is smaller than the absolute value of the light emitting start voltage is greater than a number of pulses of a voltage which is bigger than the absolute value of the light emitting start voltage.

2. A method of driving an organic EL device according to claim 1, wherein the pulses of the positive and negative voltage which is smaller than the absolute value of the light emitting start voltage are in a sine wave form.

3. A method of driving an organic EL device according to claim 1, wherein the pulses of the positive and negative voltage which is smaller than the absolute value of the light emitting start voltage are in a triangle wave form.

4. A method of driving an organic EL device according to claim 1, wherein the pulses of the positive and negative voltage which is smaller than the absolute value of the light emitting start voltage are in an alternative DC wave form.

5. A method of driving an organic EL device according to claim 1, wherein the pulses of the positive and negative voltage which is smaller than the absolute value of the light emitting start voltage are in a sawtooth wave form.

6. A method of driving an organic EL device according to claim 2, wherein a peak of the sine wave form is limited.

7. A method of driving an organic EL device according to claim 6, wherein both peaks of the sine wave form are limited.

8. A method of driving an organic EL device according to claim 6, wherein the limited peak is a positive value.

9. A method of driving an organic EL device according to claim 6, wherein the limited peak is a negative value.

10. A display device which includes a drive power source for supplying a drive signal to organic EL devices which are arranged in a matrix array on respective intersecting portions of a plurality of scanning lines and a plurality of data lines, wherein the drive power source supplies a high and low voltage in turn which is smaller than a value of a light emitting start voltage of the organic EL device during an off period of the organic EL device, wherein a number of pulses of the high and low voltage which is smaller than the value of the light emitting start voltage is bigger than the number of pulses of the voltage which is bigger than the value of the light emitting start voltage.

11. A method of driving an organic EL device according to claim 10, wherein the pulses of the high and low voltage which is smaller than the value of the light emitting start voltage are in a sine wave form.

12. A method of driving an organic EL device according to claim 10, wherein the pulses of the high and low voltage which is smaller than the value of the light emitting start voltage are in a triangle wave form.

13. A method of driving an organic EL device according to claim 10, wherein the pulses of the high and low voltage which is smaller than the value of the light emitting start voltage are in an alternative DC wave form.

14. A method of driving an organic EL device according to claim 10, wherein the pulses of the high and low voltage which is smaller than the value of the light emitting start voltage are in a sawtooth wave form.

15. A method of driving an organic EL device according to claim 11, wherein a peak of the sine wave form is limited.

16. A method of driving an organic EL device according to claim 15, wherein both peaks of the sine wave form are limited.

17. A method of driving an organic EL device according to claim 15, wherein the limited peak is high value.

18. A method of driving an organic EL device according to claim 15, wherein the limited peak is low value.

* * * * *